US005913930A

United States Patent [19]

Fick

[11] Patent Number: 5,913,930

[45] Date of Patent: Jun. 22, 1999

[54] COOLING BED FOR RAILS

[75] Inventor: Gérard Fick, Colmen, France

[73] Assignee: Koch Transporttechnik GmbH, Wadgassen, Germany

[21] Appl. No.: 08/937,036

[22] Filed: Sep. 24, 1997

[30] Foreign Application Priority Data

Sep. 26, 1996 [DE] Germany ..... 196 39 482

[51] Int. Cl.[6] ..... B21B 339/20

[52] U.S. Cl. ..... 72/250; 72/252; 72/405.12; 72/419; 72/11.5; 198/468.2; 414/751

[58] Field of Search ..... 72/250, 251, 252, 72/419, 422, 423, 426, 405.9, 405.11, 405.12, 8.8, 11.5; 198/468.01, 468.2, 469.1, 470.1, 478.1; 414/749, 750, 751, 753

[56] References Cited

U.S. PATENT DOCUMENTS

| | | | |
|---|---|---|---|
| 3,520,167 | 7/1970 | Hewitt | 72/252 |
| 3,737,021 | 6/1973 | Reth et al. | 72/251 |
| 5,205,702 | 4/1993 | Varwig | 414/751 |
| 5,245,853 | 9/1993 | Stubbs | 72/421 |
| 5,402,663 | 4/1995 | Rit et al. | 72/11.5 |

FOREIGN PATENT DOCUMENTS

| | | | |
|---|---|---|---|
| 2827408 | 1/1980 | Germany | 72/251 |

*Primary Examiner*—Joseph J. Hail, III
*Assistant Examiner*—Ed Tolan
*Attorney, Agent, or Firm*—Friedrich Kueffner

[57] ABSTRACT

A cooling bed for rails (3) with an apparatus (12) which is intended for transferring the rails (3) onto the cooling bed (1) from an infeeding roller table (2) and is set up to bend the rails (3) counter to the bending which they undergo during cooling is constructed as follows:

Said apparatus (12) has supports (25) which can be raised and lowered, can be displaced into the cooling bed (1) from the roller table (2) and are intended for the rails (3). In each case one abutment which is directed towards the underside of the rail foot and one abutment which is directed towards the top side of the rail foot are arranged on supports (25). The displacement paths of the supports (25) are controlled in accordance with the desired bending. The front abutment (37), as seen in the direction of displacement, can be let down into the support (25) by pivoting forwards and downwards. The rear abutment (39), as seen in the direction of displacement, can be drawn back behind a shoulder of the support (25) by pivoting upwards and rearwards.

10 Claims, 3 Drawing Sheets

COOLING BED FOR RAILS

BACKGROUND OF THE INVENTION

1. Field of the Invention

The invention relates to a cooling bed for rails with an apparatus which is intended for transferring the rails onto the cooling bed from an infeeding roller table and is set up for bending the rails counter to the bending which they undergo during cooling.

2. Description of the Related Art

The known apparatuses of this type grip behind the rail foot by means of hooks and drag the rail over onto the cooling bed from the roller table. In this case, the rail is moved by a greater distance in the central region of its length than in the end regions. The rail is bent in this way. As it moves over the cooling bed, the rail bends back and, ultimately, even bends to some extent towards the other side. However, the bending, in particular at the ends, produced by the apparatus is often inadequate. The reason for this is that, towards the ends, the length remaining on the far side of a drawing hook, and thus the mass of the rail, and thus the frictional force restraining the rail here, decreases. Ultimately, the frictional force is no longer sufficient; an end section slips instead of bending. It is occasionally attempted to use stops to restrain the ends. However, this is unsatisfactory in various respects. Mainly, there is a danger of buckling.

SUMMARY OF THE INVENTION

The object of the invention is to provide a reliable apparatus for transferring and, at the same time, bending the rails.

This object is achieved according to the invention in that the apparatus has supports which can be raised and lowered, can be displaced into the cooling bed from the roller table and are intended for the rails, and there are arranged on the supports abutments which are directed towards the underside of the rail foot at least in a central region of the rail length and abutments which are directed towards the top side of the rail foot at least in the end regions of the rail length, and the displacement paths of the supports are controlled in accordance with the desired bending.

In a position in which they are located between rollers of the roller table, the supports are raised above the transporting plane of the roller table and receive the rail. They move the rail onto the cooling bed and deposit it there by being lowered beneath the plane of the cooling bed again. During the transporting operation, the rail is bent exclusively at the rail foot, in a precise manner, by the action of the abutments. The rail head does not butt against any stops and does not receive any drag marks. The rest of the as yet red-hot, and accordingly flexible, rail is also handled carefully. The rail foot does not receive any drag marks either, and the action of the abutments, preferably with convex contact surfaces, does not leave any detrimental impressions behind.

Usually in each case one abutment which is directed towards the underside of the rail foot and one abutment which is directed towards the top side of the rail foot are provided, to be precise on all of the supports. This provides safety and the possibility of obtaining any desired bend. In unchanging production, however, it would also be possible to provide sometimes only abutments which act in one direction and at other times only abutments which act in the other direction.

Abutments which are arranged rigidly on the supports, and rise up alongside the rail foot on one side or the other of the same when the supports are raised, are conceivable in principle. Expediently, however, at least the front abutment, as seen in the direction of displacement, can be let down into, preferably pivoted forwards and downwards into, the support. This obviates the need for such a large displacement of the supports and, in particular, the cooling bed can also be used for other rolled sections which require support which is planar throughout.

Moreover, the ability of the abutment to pivot forwards and downwards into the recess, i.e. upwards into the operative position and towards the rail foot, means that the risk of damage to the rail foot is extremely small.

On the other hand, the rear abutment, as seen in the direction of displacement, could well be rigid insofar as its vertical position is not important for the rearward displacement of the support and it would also still leave space for a rolled section other than a rail. Expediently, however, the rear abutment, as seen in the direction of displacement, is also pivotable, to be precise in the opposite direction to the front abutment. That is to say it can be drawn by pivoting upwards and rearwards and can be advanced by pivoting forwards and downwards. The two abutments can thus grip the rail foot in the manner of a finger and thumb, but with play.

According to a further expedient configuration of the invention, the abutments, including a common drive, via a lever linkage, are arranged in a structural unit which can be adjusted horizontally relative to the rest of the support and, in addition, preferably forms a shoulder behind which the rear abutment, as seen in the direction of displacement, can be drawn. Said adjustability allows the position of the two abutments to be adapted to different rail cross-sections such that the rail head terminates essentially flush with the support and, as a result, one rail can always be positioned closely to the other. Furthermore, the support surface can be adapted to different cross-sectional sizes of other rolled sections. Said shoulder forms, for these, a stop which carries these along during the acceleration at the start of the displacement.

The supports can expediently be raised and lowered such that they are arranged as carriages on a guide, which can be raised and lowered and is arranged beneath the roller table and the cooling bed, and are displaceable preferably by means of a chain drive.

According to a further advantageous configuration of the invention, the supports can be shifted separately, by in each case one distance-measuring device which is directed onto the rail, into the position in which they are raised. As a result, the supports, in particular the abutments, can be moved in each case precisely beneath the rails which are already arriving, somewhat out of true, on the roller table.

According to a further advantageous and expedient configuration of the invention, the displacement time is the same for all the supports, different speeds corresponding to the different displacement paths. In this case, the bending operations do not proceed with the rails at different degrees of cooling.

BRIEF DESCRIPTION OF THE DRAWINGS

An exemplary embodiment of the invention is represented in the drawings, in which.

DESCRIPTION OF THE PREFERRED EMBODIMENTS

Figure 1:
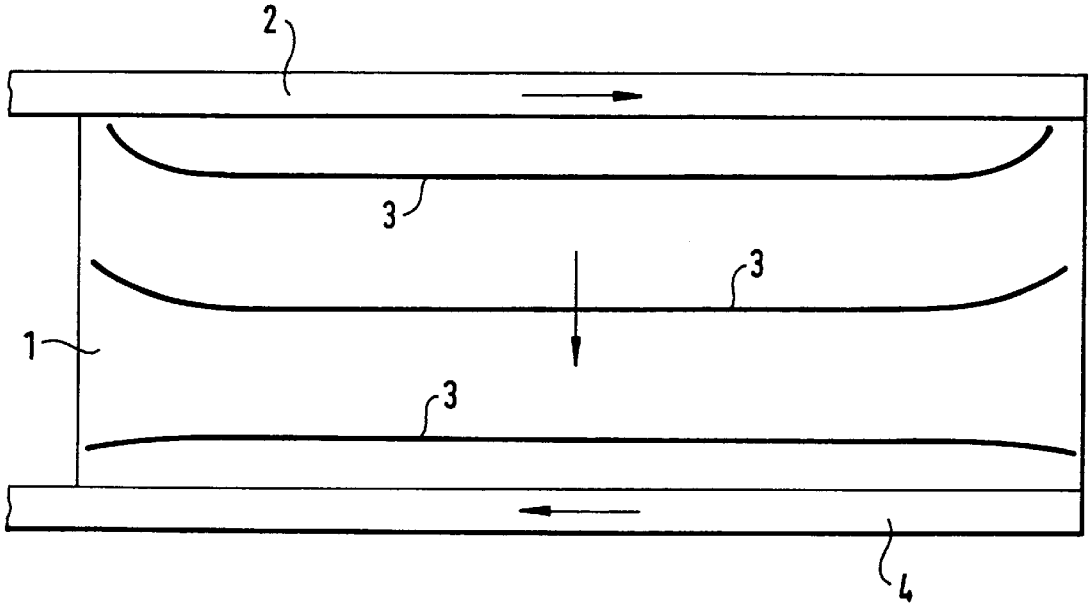
FIG. 1 shows, schematically, a plan view of a cooling bed.

The cooling bed, which is designated by 1, is charged with rails 3 by a roller table 2, the progression of the rails over the cooling bed and the form which they assume in the process being illustrated schematically in FIG. 1. In reality, the rails are located closely together. They are conveyed away by a roller table 4.

Figure 2:
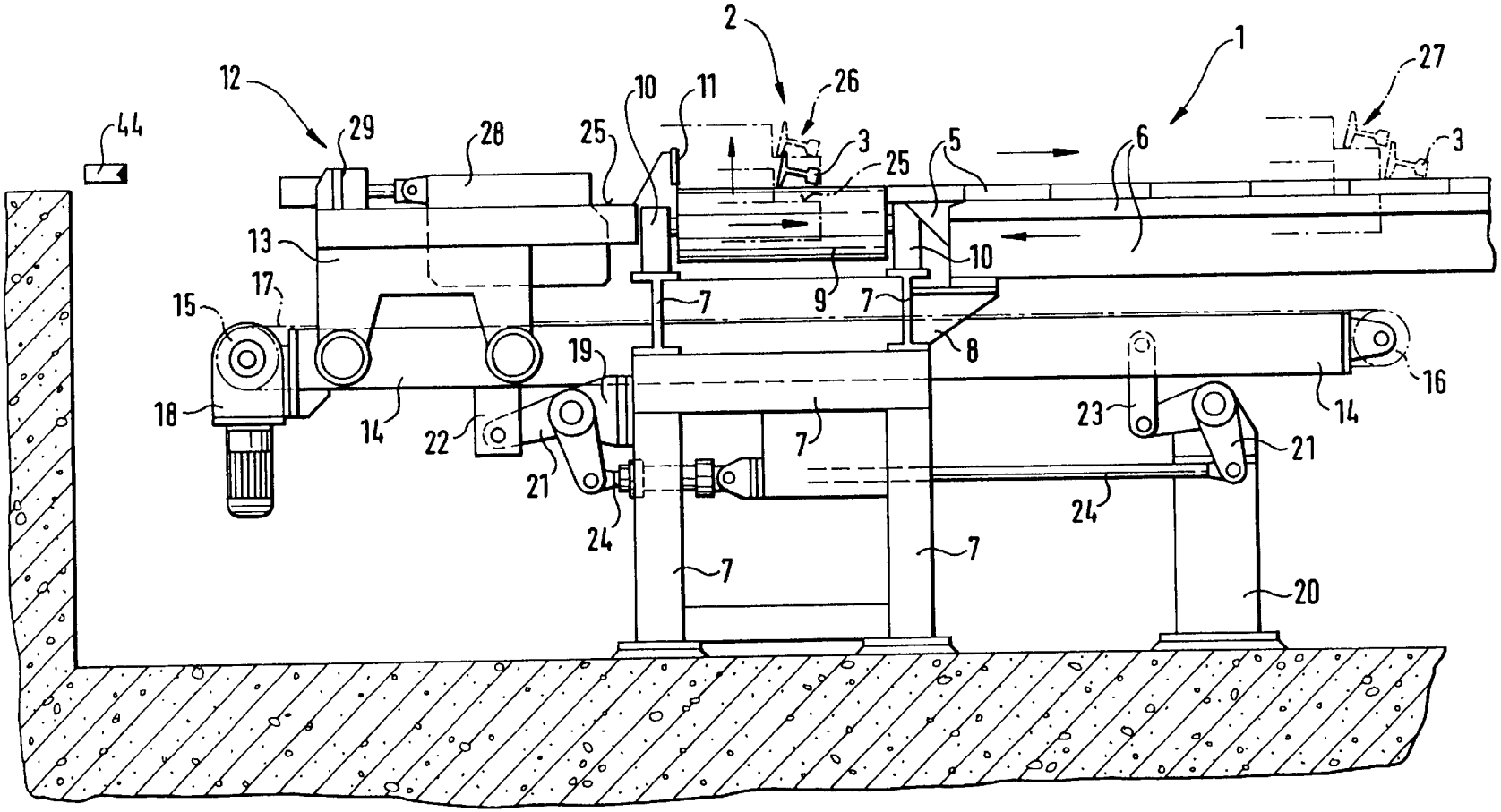
FIG. 2 shows, on an enlarged scale, a vertical section through part of the cooling bed.

The cooling bed 1 is constructed in the manner of a walking-beam conveyor with a fixed grating 5 and a walking-beam grating 6, which appear in FIG. 2

The roller table 2 has a substructure 7, on which also the ends of the beams of the walking-beam grating 6 are supported via brackets 8. The rollers of the roller table 2 are designated by 9, and their bearings are designated by 10. On the side located opposite the cooling bed 1, the roller table 2 is bounded by a guide strip 11.

The following apparatus 12 is used for transferring the rails 3 onto the cooling bed 1 from the roller table 2:

A number of, for example thirty, carriages 13 can be displaced or moved, by means of a chain drive, in each case on one guide 14 in the form of a U-profile. The chain drive comprises a chain 17, which is positioned over a drive roller 15 and a deflection roller 16, as well as a gear motor 18. The guide 14 is supported, such that it can be raised and lowered, on a bracket 19 of the substructure 7 and on a column 20 via angle levers 21, which are mounted in the brackets 19 and the column 20, and two intermediate supports 22 and 23, of which the intermediate support 22 is connected to the guide 14 in a rigid manner and the intermediate support 23 is connected thereto in an articulated manner. The angle levers 21 can be pivoted in the same direction by a hydraulic rod drive 24.

FIG. 2 shows one end position of the angle levers 21, in which position the guide 14 assumes its bottom position. The carriage 13 is depicted in its initial position.

For the purpose of transferring onto the cooling bed 1 the rail 3 which is depicted on the rollers 9 by solid lines, the carriage moves, between two rollers 9, into a position in which it is located, by way of a support 25, beneath the rail 3. By virtue of the guide 14 being raised, the support 25 is then raised above the conveying plane of the roller table 2 and thus receives the rail. The top end position is illustrated by chain-dotted lines at 26.

In this top position of the guide 14, the carriage continues between two beams of the gratings 5 and 6. At 27, by virtue of the guide 14 being lowered, the support 25 is then lowered beneath the carrying plane of the fixed grating 5 and the rail 3 is thus set down on the grating 5. The carriage 13 along with the support 25 then moves back. However, measures which are discussed in the following text are also taken between the position 26 and the position 27.

Figure 3:
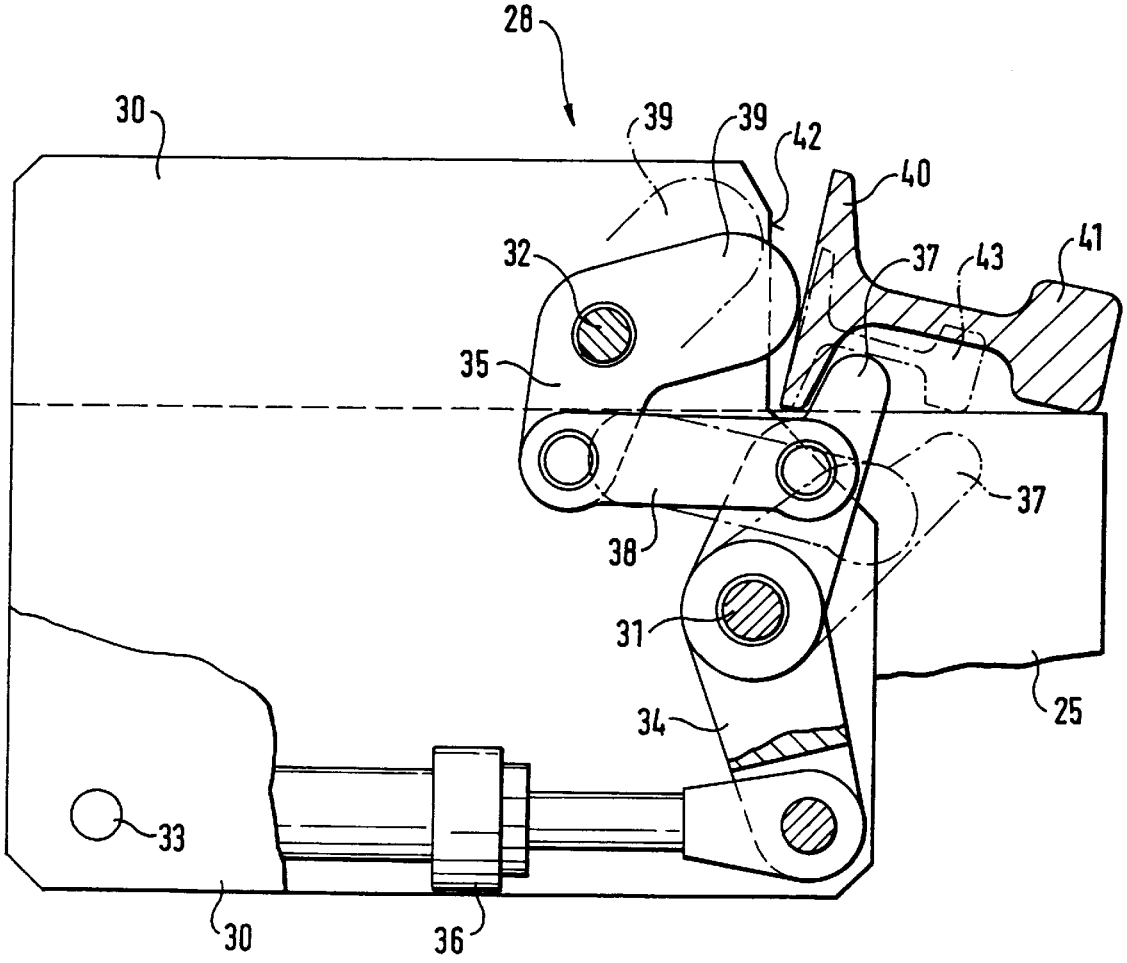
FIG. 3 shows, on a further-enlarged scale and in a section which is offset slightly with respect to FIG. 2, a detail from FIG. 2.

For these measures, there is arranged in the carriage 13 a structural unit 28 which can be adjusted horizontally by means of a crank mechanism 29 or the like and the details of which are illustrated in FIG. 3. The structural unit 28 is arranged between the two parts of the support 25, which is divided into two parts. The section of FIG. 2 is positioned in front of the support 25 as a whole and shows the carriage 13 in side view. The section of FIG. 3 is positioned between the two parts of the support 25, through the structural unit 28; looked at in another way, the front side wall of two identical side walls 30 of the structural unit has been broken away.

Between the two side walls 30, an angle lever 34, an angle lever 35 and a hydraulic or pneumatic drive 36 for the two levers are mounted pivotably on spindles 31, 32 and 33 which are connected rigidly to the side walls 30. The drive 36 acts on one arm of the angle lever 34. The angle lever 35 is connected to the other arm, which forms an abutment 37, by an articulated intermediate element 38. The intermediate element 38, in turn, acts on one arm of the angle lever 35, while the other arm forms an abutment 39.

Abutments 37 and 39 are the arms for the rail foot 40, the latter being received between these arms while the rail head 41 terminates approximately flush with the support 25. Depicted in solid lines, this is the operative position of the abutments 37 and 39: the abutment 39 is located with its convex end approximately in front of the centre of the underside of the rail foot. The abutment 37, which is likewise of convex configuration at the end, is located with its short length crosswise in front of the top side of one half of the rail foot.

In the drawn-back position, which is depicted by dashes, the abutment 37 has been lowered beneath the surface of the support 25 and the abutment 39 has been drawn back behind a shoulder 42, which is formed on the support 25 by a section of the side walls 30 which projects beyond the support 25.

As is indicated by way of a smaller rail section 43, depicted by dashes, the abutments 37 and 39 are suitable for various section sizes. For the smaller rail section 43, the crank mechanism 39 or the like would adjust the structural unit 28 further to the right until, once again, the rail head terminates approximately flush with the support 25.

Each carriage 13 is assigned a distance-measuring device 44 which determines the position of the rail 3 in the region of the relevant carriage and allows the carriage to move beneath the rail such that the support 25 receives the rail precisely at the desired location. The abutments are then pivoted into their operative position and grip round the rail foot. As a result, by displacing the various carriages by different extents, the rail is bent in accordance with these differences. It does not matter whether, at the relevant location, pressure is exerted on the rail from one side or the other: the necessary abutment 37 or 39 is always present.

I claim:

1. A cooling bed for rails with an apparatus for transferring the rails onto the cooling bed from an infeeding roller table and for bending each rail counter to bending undergone by the rail during cooling, each rail having a length and a foot, the apparatus of the cooling bed comprising a plurality of supports for the rail and means for displacing each support along a displacement path in a direction perpendicularly of a longitudinal direction of the rail, means for raising each support for receiving a rail and means for lowering each support for placing the rail onto the cooling bed, wherein at least the supports in a central region of the rail length have a rear abutment directed toward an underside of the rail foot, and wherein at least the supports in end regions of the rail length have a front abutment directed toward a top side of the rail foot, such that bending of the rail is effected by displacing the supports along different displacement paths.

2. The cooling bed according to claim 1, wherein each support has a front abutment and a rear abutment.

3. The cooling bed according to claim 1, further comprising means for pivoting each front abutment downwardly below an upper surface of the support.

4. The cooling bed according to claim 3, further comprising means for pivoting each rear abutment rearwardly behind a shoulder of the support.

5. The cooling bed according to claim 4, wherein the front and rear abutments are thumb-shaped.

6. The cooling bed according to claim 4, further comprising a lever linkage connected through a drive to the means for pivoting the front abutment and the means for pivoting the rear abutment, such that the front and rear abutments are pivoted simultaneously.

7. The cooling bed according to claim 4, wherein each support comprises a structural unit and means for adjusting the structural unit horizontally relative to the support, wherein the abutment is mounted in the structural support, and wherein the structural unit forms the shoulder.

8. The cooling bed according to claim 1, wherein the supports are comprised of carriages mounted on a guide, comprising means for raising and lowering the guide, and a chain drive for displacing the support on the guide.

9. The cooling bed according to claim 1, wherein each support comprises a distance measuring device for measuring a position of the rail and for controlling the support to move in a position in which the support raises the rail.

10. The cooling bed according to claim 1, wherein the means for displacing the supports are configured to displace the supports over equal displacement times, such that different speeds of the displacement correspond to the different displacement paths.

* * * * *